US005806112A

United States Patent [19]

Harms

[11] Patent Number: 5,806,112

[45] Date of Patent: Sep. 15, 1998

[54] BABY CRIB LINER

[75] Inventor: Antionette A. Harms, Warren, Mich.

[73] Assignees: Antionette Harms, Warren; Barbara LaFave, Hazel Park; Donald Hurst, Warren, all of Mich.

[21] Appl. No.: 832,819

[22] Filed: Apr. 4, 1997

[51] Int. Cl.[6] ..... A47D 7/00

[52] U.S. Cl. ..... 5/93.1; 5/424; 5/425

[58] Field of Search ..... 5/931, 424, 426, 5/427

[56] References Cited

U.S. PATENT DOCUMENTS

| | | | |
|---|---|---|---|
| 949,389 | 2/1910 | Almgren | 5/93.1 |
| 2,128,978 | 9/1938 | Akin . | |
| 2,566,790 | 9/1951 | Bloomfield | 5/93.1 |
| 2,629,884 | 3/1953 | McMonagle . | |
| 2,637,047 | 5/1953 | Zurzolo . | |
| 3,018,492 | 1/1962 | Rosen . | |
| 3,241,158 | 3/1966 | Berl . | |
| 3,321,779 | 5/1967 | Kaufman et al. | 5/93.1 |
| 3,619,824 | 11/1971 | Doyle . | |
| 3,803,646 | 4/1974 | Newerowski . | |
| 4,525,883 | 7/1985 | Necowitz . | |
| 4,670,923 | 6/1987 | Gabriel . | |
| 4,754,509 | 7/1988 | Pollard . | |
| 4,800,600 | 1/1989 | Buam . | |
| 5,010,611 | 4/1991 | Mallett | 5/424 X |
| 5,410,765 | 5/1995 | Dicken | 5/424 X |

FOREIGN PATENT DOCUMENTS

| | | |
|---|---|---|
| 1272565 | 8/1961 | France . |

OTHER PUBLICATIONS

"Baby Dreams" Bumper Guard Product of the Bib Company, Macon, GA 31208, Date Unknown.

*Primary Examiner*—Michael F. Trettel
*Attorney, Agent, or Firm*—Peter D. Keefe

[57] ABSTRACT

A crib liner for lining a baby crib including a flexible base member for being located beneath a mattress of the crib, and a side guard attached to the periphery of the base member for lining the side walls of the crib so as to keep a baby's arms and legs inside the crib while the baby is lying down therein. The side guard is preferably attached to the base member continuously along the periphery thereof. A plurality of fasteners are attached to the side guard for attaching the crib liner to the posts and bars of the crib. In a preferred embodiment of the present invention, the base member is formed from a fabric material, and the side guard is sewn onto, or otherwise attached to the base member, preferably continuously therearound.

5 Claims, 3 Drawing Sheets

BABY CRIB LINER

BACKGROUND OF THE INVENTION

1. Field of the Invention

The present invention relates to cribs used for babies, and particularly to a liner therefor. More particularly, the present invention relates to a crib liner which provides assurance that a baby's arms and legs will remain inside the crib while the baby is lying down therein.

2. Description of the Background Art

Cribs for babies, such as for example shown at 12 in FIGS. 1 and 2, are well known and have been used for many generations. The crib 12 is of conventional construction, having a generally rectangular, box shape characterized by an open top and an opposite flat rectangular floor 14 that is supported by four vertical corner posts 16, 18, 20, 22 which also extend downwardly below the crib floor to provide legs to elevate the floor above ground level.

The crib 12 further includes first and second side walls 24, 26 respectively attached to, and extending vertically upwardly from, the floor 14 at opposite ends thereof. Each of the first and second side walls 24, 26 is constructed as a framework including upper and lower horizontal support rails such as those shown at 28 and 30, which interconnect with two of the corner posts such as those shown at 16 and 18. The horizontal support rails 28, 30, in turn, are interconnected by a plurality of vertically oriented bars (the term "bars" being inclusive of relates kinds of structures) 32.

The crib 12 still further includes third and fourth side walls 34, 36 attached to and extending vertically upwardly from the floor 14 at opposite sides thereof. In a manner similar to the construction of the first and second side walls, each of the third and fourth side walls 34, 36 is also made as a framework including upper and lower horizontal support rails such as those shown at 38 and 40, which interconnect with two of the corner posts such as those shown at 18 and 20. Once again as in the case of the first and second side walls, the third and fourth side walls include the horizontal support rails being interconnected by a plurality of vertically oriented bars 32.

In operation of the crib 12, a mattress 44 is placed therein on the crib floor 14, whereupon the crib 12 provides a protective sleep and play area for a young baby or infant child placed therein.

An item for use in conjunction with a baby crib 12, which is also shown at FIGS. 1 and 2, and which is commercially available today, is referred to as a "bumper guard" or "bumper pad" 46 and is normally sold as one part of a set which also includes a separate crib sheet and a separate blanket or comforter. The bumper pad 46 consists of a wide band 48 of padded material which is integrally formed from a single unit of layered construction and which extends around the side walls of a baby crib above the level of the mattress (see FIG. 2). The bumper pad 46 is attachable at the top and bottom thereof to bars 32 and posts of the crib by a series of pairs of fastening strips 50 which are sewn thereto. More particularly, the bumper pad 46 has fabric outer layers 52*a*, 52*b* and an inner layer 54 of padding material therebetween, wherein the band 48 is sewn closed at the top and bottom for conforming wrappingly around the side walls of the crib 12.

The design of the bumper pad 46 has some difficulties, however, in that while it does provide some extra padding for the baby, as contrasted with a crib which does not use a bumper pad, it does not promote safety to the extent that a new mother might wish. Since the known bumper pad is not attached to a sheet or to anything other than crib bars and posts, even if the bottom thereof is so attached, a baby can still manage to slide an arm or leg underneath the bottom of the bumper pad, between it and the mattress. The baby could then further extend the arm or leg outwardly from the crib between the crib bars. Possibly, a limb so extended could become stuck in an extended position, causing the baby to panic and/or to become hurt in an effort to extricate the limb. Another risk to a baby's arm or leg, which is extended in this way, is that another person passing by the crib could bump into the extended limb and harm the baby.

Therefore, a need still exists in the art for a crib liner which will protect a baby in a crib by ensuring that the baby's arms and legs will remain inside the crib while the baby is lying down therein.

SUMMARY OF THE INVENTION

The present invention is a liner for a baby crib which will protect a baby in a crib by ensuring that the baby's arms and legs will remain inside the crib while the baby is lying down therein.

A crib liner in accordance with the present invention includes, generally, a flexible base member for being placed in a baby crib beneath the mattress thereof, and a side guard attached to the base member which lines the side walls of the crib so as to keep a baby's arms and legs inside the crib while the baby is lying down therein. The side guard is attached to the base member preferably continuously around the perimeter of the base member. A number of fastening strips are provided which are attached to the side guard for attaching the side guard to the posts and bars of the crib.

Improved safety and security for the baby, and increased peace of mind for the parents, are provided by providing a base member below the mattress, wherein the base member is securely attached to the side guard around the perimeter of the base member. This arrangement prevents a baby from putting an arm or a leg past the liner below the side guard and through the bars of the crib.

Accordingly, it is an object of the present invention to provide an apparatus for protecting and safeguarding a baby in a baby crib.

It is a further object of the present invention to provide a crib liner which will ensure that a baby's arms and legs will remain inside the crib while the baby is lying down therein.

Other objects, features, and advantages of the present invention will become apparent from the following detailed description section, which should be read in conjunction with the accompanying drawings. Throughout the following detailed description and in the drawings, like numbers refer to like parts throughout the several views.

DETAILED DESCRIPTION OF THE PREFERRED EMBODIMENT

Referring now to FIGS. 3 through 7, the crib liner 100 according to the present invention will be detailed.

Figure 1:
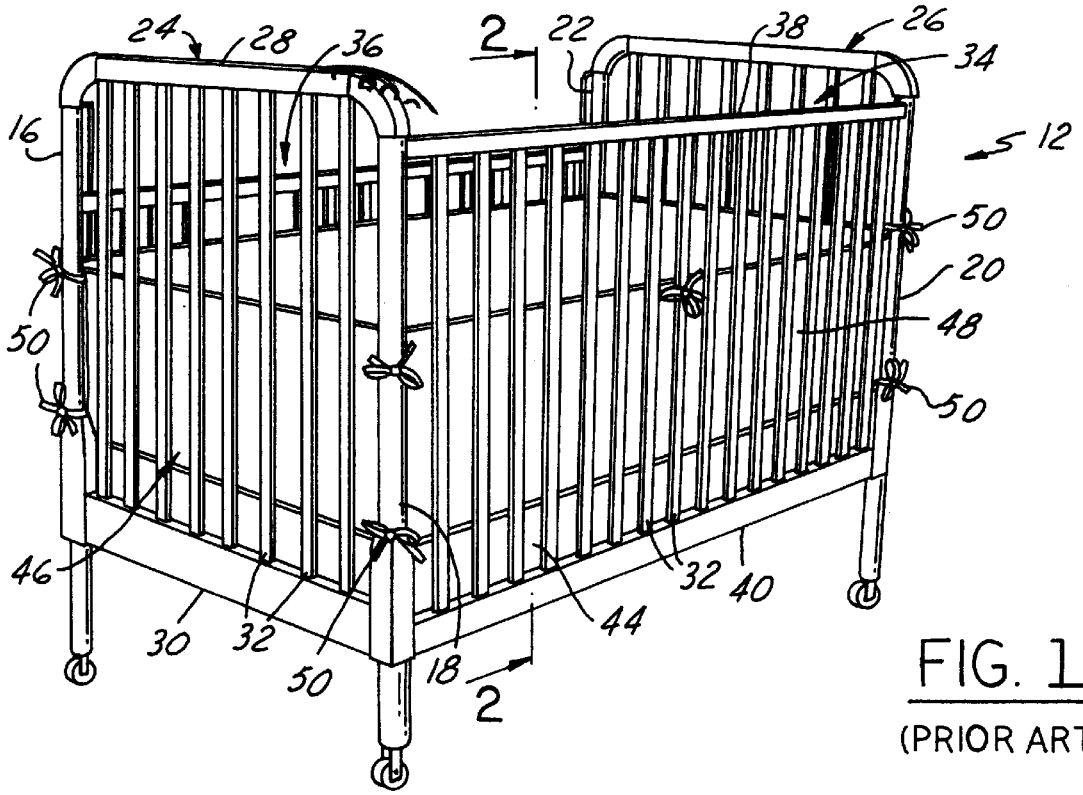
FIG. 1 (PRIOR ART)
FIG. 1 is a perspective view of a prior art baby crib with a prior art bumper pad installed therein.
Figure 2:
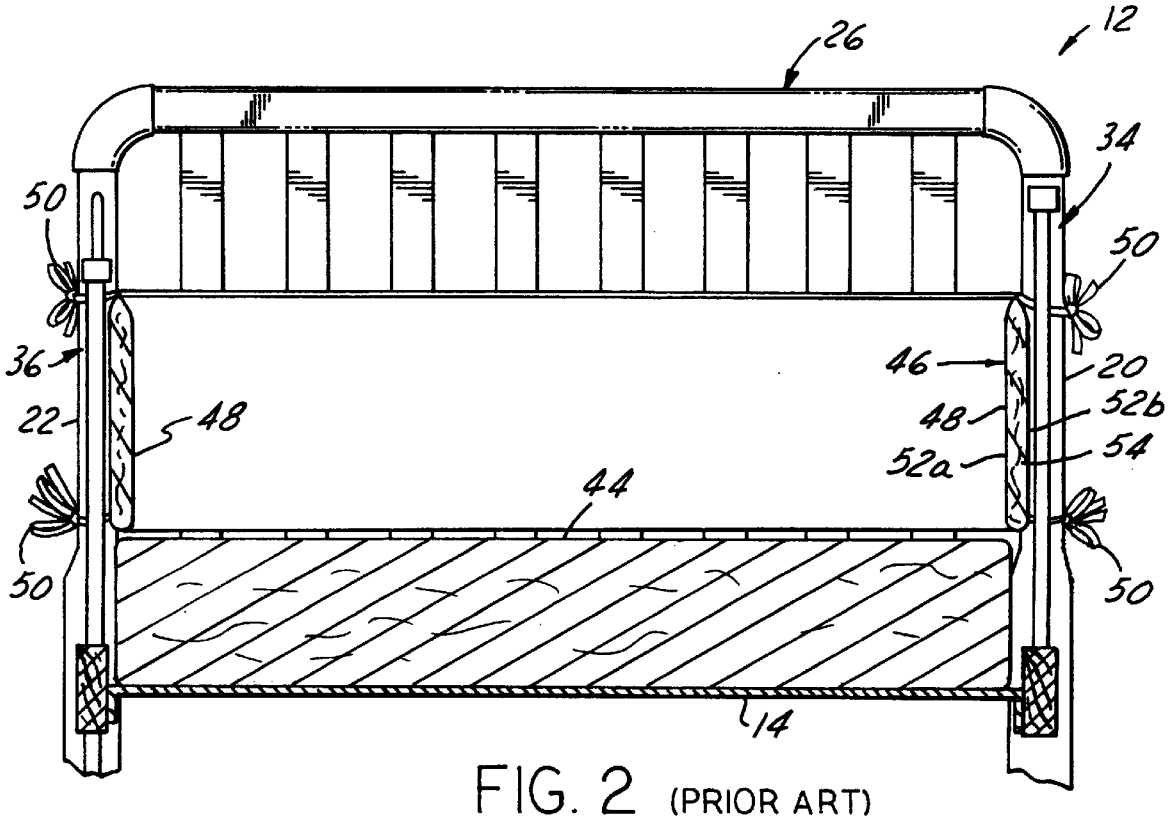
FIG. 2 (PRIOR ART)
FIG. 2 is a partly sectional end view of the prior art crib and prior art bumper pad, seen along line 2—2 in FIG. 1.
Figure 3:
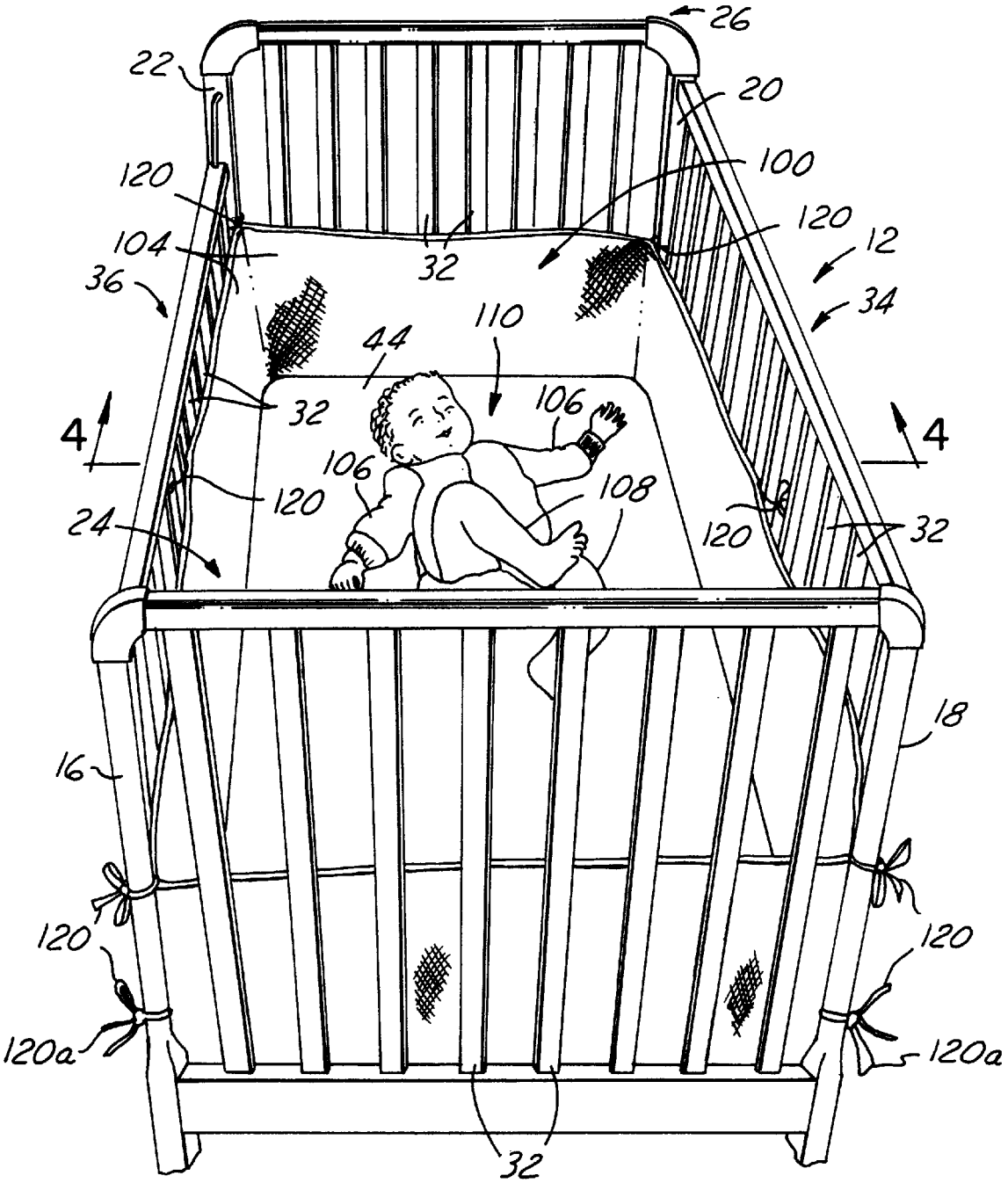
FIG. 3 is a perspective view of a prior art baby crib with a crib liner according to the present invention installed therein, from a point view near a corner of the crib.

FIG. 3 shows generally the crib liner 100 installed in a prior art baby crib 12. The crib 12 depicted is for exemplar purposes only, and a crib may be structured other than as shown, wherein the crib provides an environment of use of the crib liner 100. The structural details of a crib 12 have been recounted hereinabove, and like numerals will be used hereinafter when describing the crib. The crib liner 100 includes a base member 102 (see FIG. 4) and a side guard 104 connected to the periphery P (see FIG. 5) of the base member. In operation, the crib liner 100 is installed in a crib 12 with the mattress 44 thereof having been previously removed therefrom. After the side guard 104 has been installed so as to line the side walls 24, 26, 34, 36 of the crib 12, the mattress 44 is replaced into the crib so as to lay over the base member 102.

The crib liner 100 according to the present invention provides an increased level of protection from that offered by the crib 12 alone, by ensuring that a baby's arms 106 and legs 108 will remain inside the crib 12 while the baby 110 is lying down therein, as well as by providing a cushioning pad between the interior of the crib and the bars thereof.

Preferably, the crib liner 100 is constructed of materials which are washable in a normal domestic washing machine. The materials of the crib liner 100 are generally soft and flexible, and do not hold a fixed position on their own, but are dimensioned, constructed and arranged to fit into and to assume the orientation of the inside of a crib 12 when the crib liner is installed therein. Throughout this specification, it will be understood that the relation and orientation of the component parts of the crib liner 100 are described in an installed configuration thereof.

Figure 4:
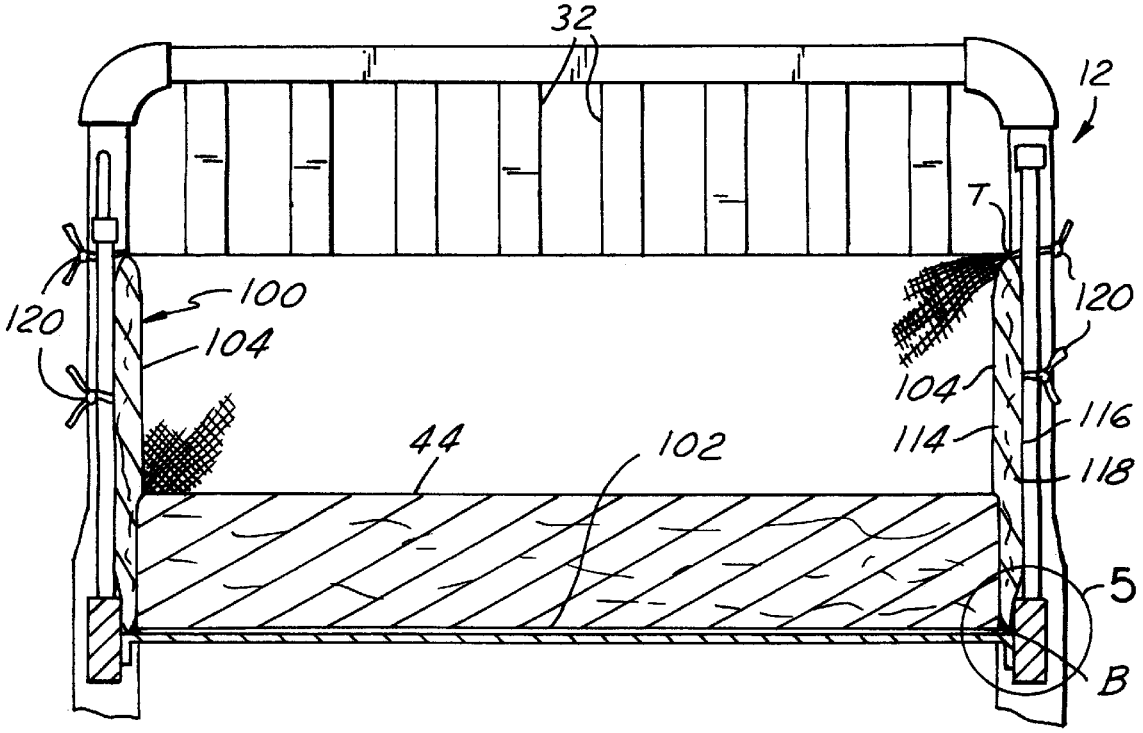
FIG. 4 is a partly sectional end view of the prior art crib and crib liner according to the present invention, seen along line 4—4 in FIG. 3.
Figure 6:
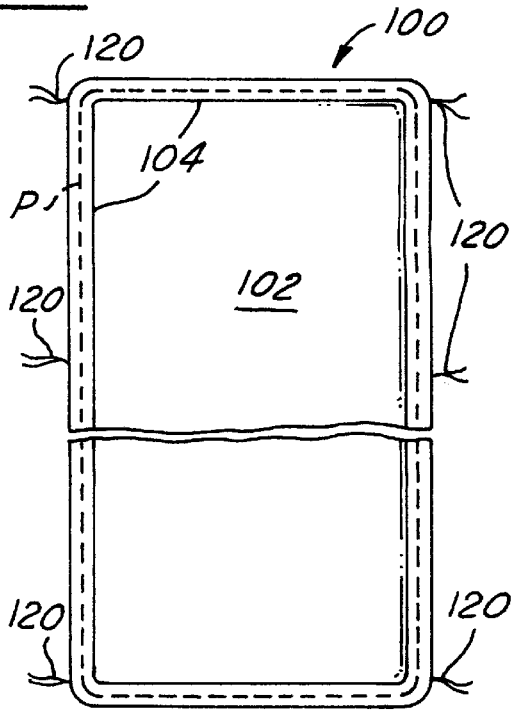
FIG. 6 is a plan view of the crib liner according to the present invention shown in its operative configuration.

As shown best at FIGS. 4 and 6, the crib liner 100 includes, as mentioned, a base member 102 which has a generally rectangular shape and size for closely conforming to that of the floor 14 of the crib 12, upon which it lays when in use. The base member 102 is preferably formed from a cloth fabric material, although an open-celled fabric webbing or a latticework made of strips of fabric or plastic could be used and would be equivalent to a fabric sheet. A durable waterproof plastic material could also be used as an alternative material for the base member 102. The mattress 44 fits on top of the base member 102 when the crib liner 100 has been installed in the crib 12.

The crib liner 100 also includes, as mentioned, a side guard 104 which is attached to, and which extends vertically upwardly from, the base member 102 when installed, and which extends around the interior of the side walls of the crib 12 beside and above the mattress 44. The side guard 104 is characterized as a wide band of padded material which is integrally formed from a single unit of layered construction and is sewn closed at the ends thereof. The side guard 104 wraps around, and is attached to, the periphery P of the base member 102, such as by sewing 112 (see FIGS. 5 and 6).

Figure 5:
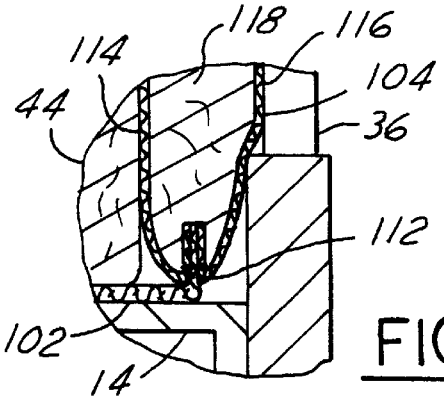
FIG. 5 is a detail corner view, seen at circle 5 of FIG. 4.

As best seen at FIGS. 4 and 5, the side guard 104 is a resilient pad having a fabric inner wall 114, a fabric outer wall 116 which is attached to the inner wall at the top and bottom thereof (such as by being folded over at the top T and sewn together at the bottom B), and a padding material 118 disposed between the inner and outer walls. The bottom B of the side guard 104 is attached to the base member 102 preferably continuously along the perimeter P thereof. Preferably, this attachment modality simultaneously provides the aforementioned attachment of the inner and outer walls at the bottom B using the sewing 112. The padding material 118 may be cotton or polyester batting, a closed-cell resilient foam material, or another type of padding. The inner wall 114 may also be sewn to the outer wall 116 in a plurality of areas to hold the padding material 118 in place. While the padding material 118 is present in the preferred embodiment of the present invention, it is not essential to the practice hereof if a quilted type of material is used for the inner and outer walls 114, 116.

The side guard 104 preferably is formed of a continuously running band, as shown at FIG. 6, which, as shown at FIG. 3 provides covering of the side walls 24, 26, 34, 36 of the crib 12. The side guard 104 thereby provides cushioning with respect to the bars 32 and posts 16, 18, 20, 22 of the crib 12, and further provides prevention of the baby 110 from placing his of her limbs 106, 108 out from between the bars and posts. The height of the side guard 104 above the base member 102 is selected to reasonably accommodate the height of the side walls of a baby crib. For example, it is preferred for the height of the side guard 104 to be somewhat over one-half the height of the side walls (as shown), although the height of the side guard could be shorter or higher, even equally as high as the side walls. Since some baby cribs have adjustable side walls which can be raised or lowered relative to the floor 14, this should be taken into account when selecting an appropriate height of the side guard 104, and the aforementioned preferred height would serve cribs of this type quite well.

The bottom B of the side guard 104 is sewn, such as by sewing 112, or is otherwise securely fastened to the base member 102 along the periphery P thereof, preferably continuously therealong. It is possible, though not preferred, for the bottom B to be attached to the periphery P of the base member 102 at mutually spaced discrete locations along the periphery. However in this regard, the placement of these attachment locations should be close together if the feature of preventing baby limbs emerging through the bars and posts is to be provided.

A plurality of fastening strips 120 are attached to the outer wall 116 of the side guard 104 at a plurality of locations therearound for attaching the side guard to the crib 12 at the posts and bars thereof. Preferably, the fastening strips 120 are in the form of a pair of fabric strips which can be wrapped around parts of the crib 12 (ie., the bars and posts) and tied together, such as in a bow. It is preferred that fastening strips 120 be located on the side guard 104 so as to attach the crib liner 100 to the crib 12 at each of the four corner posts 16, 18, 20, 22 and to a bar 32 of the crib adjacent the middle of each of the first and second side walls 34, 36. Also, while not necessary to operation, it is preferred to include a second fastening strips 120*a* attached to the outer wall 116 so as to wrap around the posts midway between the top T and the mattress 44.

Those skilled in the relevant art will realize that with the crib liner 100 hereof installed in place in a crib 12 and fastened thereto by the fastening strips 120, and with a mattress 44 installed thereon, the crib liner 100 will be held stably and securely in place with respect to the crib. This feature is amplified because the lower portion of the side guard 104 adjacent the bottom B thereof tends to stay in place because it is compressably held between the mattress and the sidewalls of the crib 12 (see FIG. 4). Further, since the side guard 104 is attached to the base member 120 at a level below the mattress 44, and is preferably securely sewn or otherwise continuously fastened to the base member around the periphery P thereof, a baby 110 in the crib 12 will be prevented from getting his or her limbs 106, 108 out of the crib 12 by passing between the side guard 104 and the base member 102. As a result, a baby 110 in the crib 12 will not be able to contact the bars or posts of the crib at any level that the baby can reach while lying down in the crib. A baby will only (depending upon the selected height of the side guard above the mattress, the child's age and his or her ability to stand) be able to reach out of the crib at a level above the top T of the side guard 104, and the baby will have to stand up to do this. Accordingly, the baby's health and safety, as well as the peace of mind of the baby's parents, is promoted by the use of the present invention.

Figure 7:
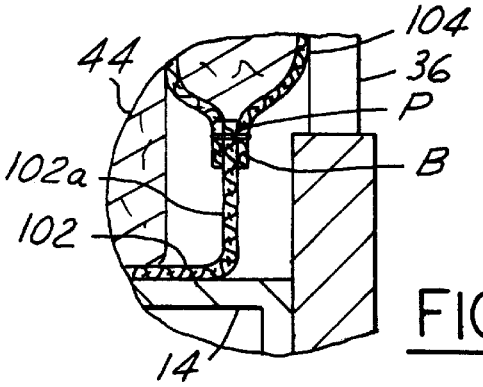
FIG. 7 is a detail corner view of an alternative embodiment of the crib liner according to the present invention.

While it is preferred for the base member 102 to lie flatly across the floor 14 of the crib 12, the base member may have upwardly directed outer portions 102*a*, as shown at FIG. 7. In this case, attachment of the side guard 104 to the periphery P of the base member 102 includes the base member being configured so as to partly extend up along the side walls of the crib besides lying on the floor of the crib. In any event, such structural modification would desirably provide for the bottom B of the side guard to be located below the top of the mattress 44.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

What is claimed is:

1. A baby crib and crib liner therefor, comprising:

a baby crib comprising:

a floor;

a mattress layable upon said floor; and a plurality of side walls located adjacent said floor and oriented substantially perpendicular with respect thereto; and a crib liner comprising:

a flexible base member having a periphery, wherein said base member extends across the periphery, said base member being dimensioned to be layable upon said floor and to receive said mattress thereupon;

a side guard having a lower edge, said side guard comprising an inner wall, an outer wall, and a padding material disposed therebetween, said lower edge being attached to said base member along said periphery, said side guard being disposed adjacent said plurality of side walls so as to wrappingly line said plurality of side walls, wherein a portion of said side guard inclusive of said padded material is disposed between said mattress and said plurality of side walls along said periphery; and fastening means for attaching said side guard to said plurality of side walls;

wherein said base member lies upon said floor and said mattress lies upon said base member.

2. The baby crib and crib liner of claim 1, wherein said side guard is attached to said base substantially continuously around said perimeter.

3. The baby crib and crib liner of claim 2, wherein said fastening means comprises a plurality of fastening strips attached to said side guard.

4. The baby crib and crib liner of claim 3, wherein said base member is formed from a fabric material.

5. A method for providing a baby crib liner for a baby crib having a floor, a mattress supported by the floor, and a plurality of side walls, said method comprising the steps of:

connecting a flexible base member to a padded side guard along a periphery of the base member;

placing the base member upon the floor of a baby crib;

attaching the side guard to the plurality of side walls of the baby crib; and placing a mattress of the baby crib upon the base member so as to be supported by the floor, wherein padding of the side guard is disposed between the mattress and the side walls along the periphery.

* * * * *